US005257611A

United States Patent [19]

Chapekis et al.

[11] Patent Number: 5,257,611

[45] Date of Patent: Nov. 2, 1993

[54] IGNITION COIL ASSEMBLY AND METHOD OF MANUFACTURE THEREOF

[75] Inventors: Philip C. Chapekis, Ypsilanti; Cherry L. T. Green, Canton; Robert L. Hancock, Ann Arbor; James P. Morris, Saline; Rebecca A. Mulrooney, Farmington Hills; James Peretick, Saline; Gregg M. Stefansky, Ferndale, all of Mich.

[73] Assignee: Ford Motor Company, Dearborn, Mich.

[21] Appl. No.: 31,066

[22] Filed: Mar. 12, 1993

Related U.S. Application Data

[63] Continuation of Ser. No. 812,419, Dec. 23, 1991, abandoned.

[51] Int. Cl.[5] ..... F02P 3/02; H01F 15/10; H01F 27/02

[52] U.S. Cl. ..... 123/634; 29/606; 123/643; 336/96; 336/107

[58] Field of Search ..... 123/634, 635, 643; 29/606; 336/92, 96, 107

[56] References Cited

U.S. PATENT DOCUMENTS

| | | | |
|---|---|---|---|
| 2,447,376 | 8/1948 | Tognola | 336/92 |
| 3,141,923 | 7/1964 | Henschke et al. | 174/59 |
| 3,864,002 | 2/1975 | Naser et al. | 339/147 R |
| 3,935,852 | 2/1976 | Donovan et al. | 123/634 X |
| 4,658,799 | 4/1987 | Kusaka et al. | 123/622 |
| 4,763,094 | 8/1988 | Kojima | 336/92 |
| 4,834,056 | 5/1989 | Kawai | 123/634 |
| 4,843,362 | 6/1989 | Heritier-Best | 336/61 |
| 4,849,728 | 7/1989 | Goll et al. | 336/92 |
| 4,918,419 | 4/1990 | Ida | 336/96 X |
| 4,926,152 | 5/1990 | Ito et al. | 336/90 |
| 4,962,361 | 10/1990 | Ida | 336/90 |
| 5,032,814 | 7/1991 | Badaud | 336/65 |
| 5,044,328 | 9/1991 | Umezaki | 123/647 |

FOREIGN PATENT DOCUMENTS

| | | | |
|---|---|---|---|
| 253939 | 1/1988 | European Pat. Off. . | |
| 395513 | 10/1990 | European Pat. Off. . | |
| 192313 | 9/1985 | Japan | 336/96 |

*Primary Examiner*—Tony M. Argenbright
*Attorney, Agent, or Firm*—Roger L. May; Richard D. Dixon

[57] ABSTRACT

An ignition coil assembly for an internal combustion engine including an ignition coil housing having integrally molded mounting members arranged on the outer perimeter of the housing in non-interfering relationship with the internal coil/core assembly components. C-Shaped laminated cores are encased entirely within the ignition assembly housing material or encased in an elastomer such as a rubber modified polypropylene and inserted into the housing assembly. The ignition coil assembly provides for use either in a internal combustion engine with a distributor-based or distributor-less ignition system.

7 Claims, 3 Drawing Sheets

IGNITION COIL ASSEMBLY AND METHOD OF MANUFACTURE THEREOF

This is a continuation of copending application Ser. No. 07/812,419 filed on Dec. 23, 1991, now abandoned.

TECHNICAL FIELD

This invention relates to an ignition coil assembly for internal combustion engines.

This invention is related to the inventors' commonly assigned and copending application Ser. No. 811,856, filed Dec. 23, 1991, entitled "Connection For Ignition Coil Assembly."

BACKGROUND ART

Current conventional ignition coil assemblies for internal combustion engines, in particular those for vehicular applications, include a sizeable steel laminated core and associated primary and secondary coil assemblies encased within a fairly thin electrically insulating thermoplastic housing. To mount or permanently fix the coil assembly to the engine or its environs, it is known to provide mounting holes through the core, and sometimes through the surrounding housing also, as is shown in U.S. Pat. No. 4,763,094. This limits the options for placement of the coil assembly within the engine compartment. Specifically, the ignition coil assemblies mentioned above must be mounted on grounded surfaces to eliminate the possibility of electric shock. Further, it has been noted that the differences in thermal expansion coefficients between the housing and laminated core may give rise to stresses in the housing that can affect the waterproof integrity of the assembly and/or lead over time to the propagation of hairline fractures within the housing.

In instances where the core laminations would otherwise be externally exposed, such as in the four tower coil design shown in U.S. Pat. No. 4,763,094, it is also known to provide a soft water-proof layer of insulating tape or like material placed across the inner exposed surfaces of the C-shaped laminated cores. This is an expensive procedure to implement in actual mass production of the ignition coil assemblies. Utilization of the water-proof tape also necessitates adding another operation to the manufacture of the ignition coil assembly on the production assembly line.

The present invention is directed to all the foregoing concerns. Further, the present invention is directed to providing flexibility of manufacturing techniques to allow the same basic coil design to be used for distributor-based and distributorless ignition systems.

Ignition coil assemblies of the prior art are dedicated by design to either distributor or distributorless ignition systems. Distributorless ignition systems typically require high voltage output terminals equal in number to the number of cylinders of the particular engine, for example, a 4-cylinder engine would require a four tower ignition assembly like that disclosed in U.S. Pat. No. 4,763,094. This dedication to a particular ignition assembly design requires respective dedication of the production assembly line machinery to distributor or distributorless production systems.

SUMMARY OF THE INVENTION

In view of the foregoing, this invention contemplates providing an ignition coil assembly for internal combustion engines having increased overall reliability and precluding any possibility of water ingress to the internal components of the ignition coil and prevents poor performance of the coil assembly while increasing overall reliability.

The invention further contemplates an ignition coil assembly having a thermoplastic housing completely enshrouding the primary and secondary coil assemblies and core member and including integrally molded mounting members arranged on the outer perimeter of the housing in non-interfering relationship with the internal coil/core assemblies.

The invention further contemplates having the C-shaped laminated core encased entirely within the ignition assembly housing.

The ignition coil assembly of the present invention includes an "I" shaped core made of laminated steel strips, a primary bobbin with insulation displacement terminals, a primary coil, a secondary bobbin with integrally connected high voltage tower terminals, a secondary coil, high voltage towers, and an ignition assembly housing with integrally formed mounting lugs and a laminated C-shaped core. The primary coil assembly is placed within the secondary coil assembly and both are then placed within the inner opening of the C-shaped core. The primary connector assembly is then placed over a lip portion of one side of the housing and the primary connector assembly leads then engage the insulation displacement terminals contained on the primary coil assembly.

The high voltage towers are then fastened into the terminals of the secondary coil. A potting material is subsequently introduced into the inside of the ignition coil assembly housing to encapsulate and electrically insulate the inner components of the ignition coil subassembly.

An alternative embodiment utilizes a laminated core which has been encased in an elastomer such as a rubber modified polypropylene and is not molded into the housing assembly.

The invention still further contemplates making relatively minor modifications in the design and manufacture of the ignition coil assembly to provide both distributor-based and distributorless ignition systems.

The foregoing and other features and advantages of the present invention are readily apparent from the following detailed description of the best mode for carrying out the invention when taken in connection with the accompanying drawings.

BEST MODE FOR CARRYING OUT THE INVENTION

Figure 1:
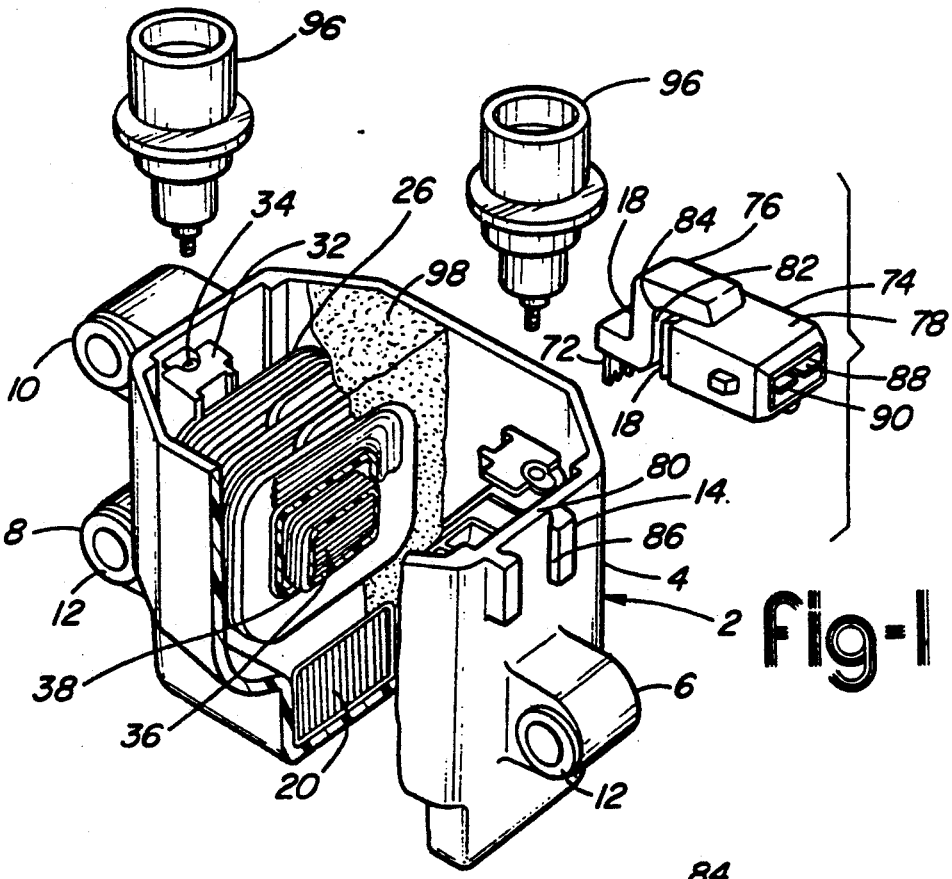
FIG. 1 is a perspective, partially sectioned, partially exploded view of an ignition coil assembly according to one embodiment of the invention.
Figure 2:
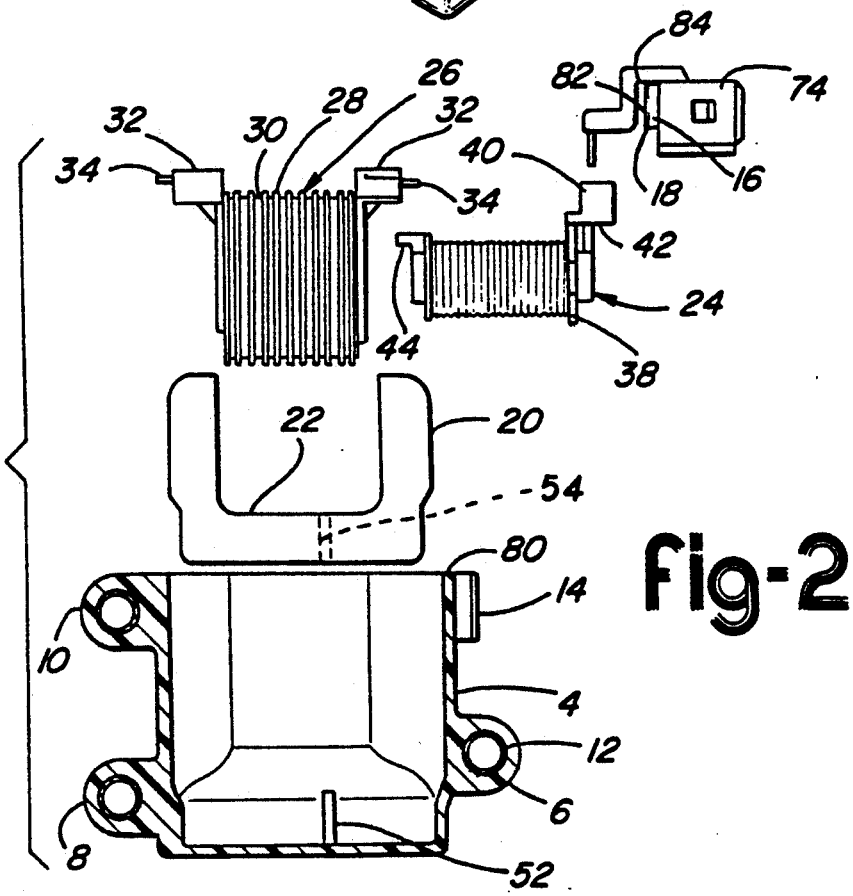
FIG. 2 is a side, partially sectioned, exploded view of the ignition coil assembly shown in FIG. 1 and with potting material and high voltage towers removed.
Figure 3:
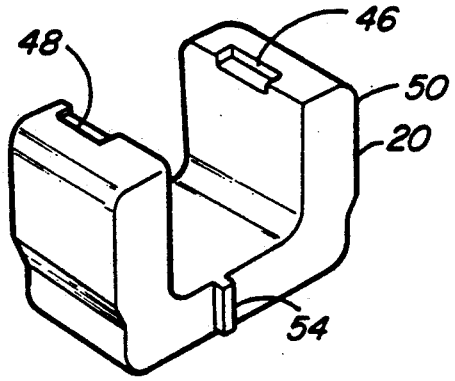
FIG. 3 is a perspective view of a C-shaped laminated core totally encased in a rubber insulation material according to the embodiment shown in FIGS. 1 and 2.
Figure 4:
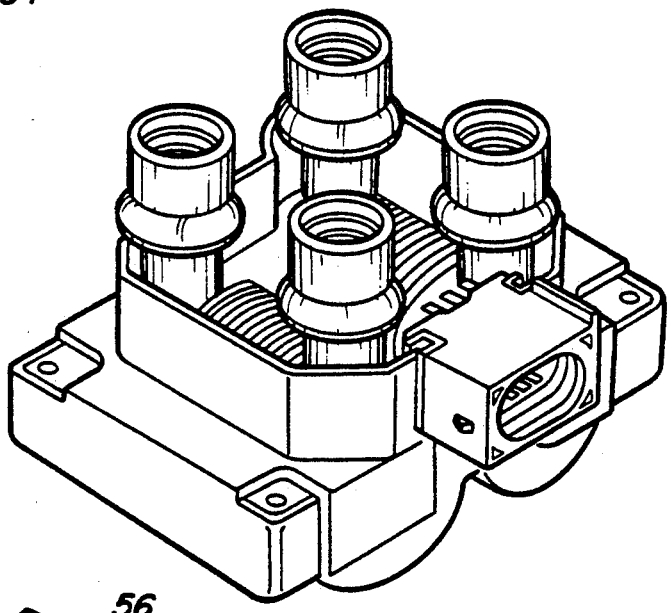
Fig-4 PRIOR ART
FIG. 4 is a perspective view of a four tower ignition coil assembly of the prior art.

Referring now to FIGS. 1, 2 and 3, an ignition coil assembly 2 of the present invention includes a housing 4 having a plurality of identical mounting members 6, 8 and 10 all disposed on the exterior of the housing and molded integrally with the housing. Elongated metal bushings 12 are positioned within the center of the mounting members to facilitate secure mounting of the ignition coil assembly within the engine compartment.

A dove tail receiving section 14 is also integrally molded onto the outside of the housing. The dove tail receiving section 14 securely receives and holds in place a corresponding dove tail locking section 16 configured on the primary connector assembly. The legs 18 on each side of locking section 16 are in slip fit engagement with and within the respective channels of the receiving section 14.

A steel laminated C-shaped core 20 is located within the housing. Core 20 is provided with an inner open cavity 22 within which is nested primary and secondary coil assemblies designated 24 and 26, respectively. The secondary coil assembly 26 includes bobbin 28. A coil 30 is wound around bobbin 28 with the ends of the coil terminating at the secondary terminal boxes 32. The secondary coil end portions are soldered to the secondary terminals 34 which are press fit into the secondary terminal boxes 32.

Figure 5:
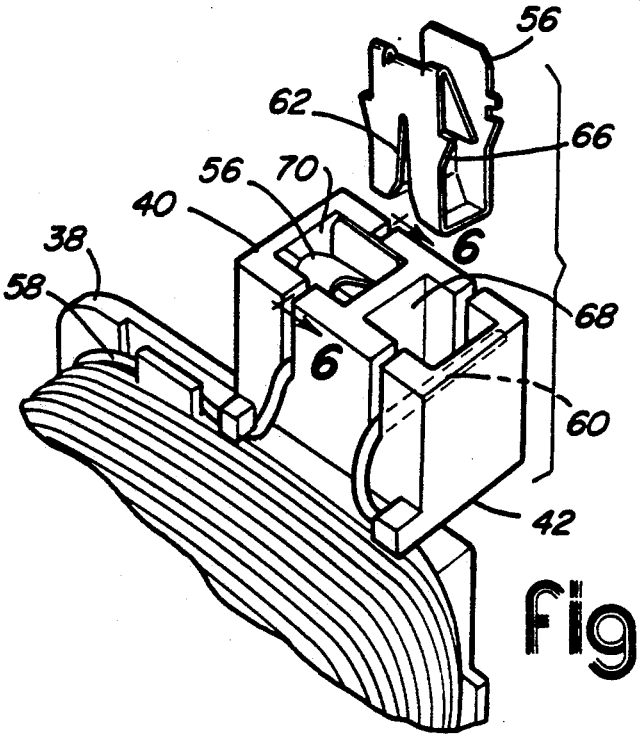
FIG. 5 is an enlarged, perspective, partially exploded view of the primary bobbin, primary coil, primary terminals and primary terminal receptacle of the present invention as shown in FIG. 1.

Referring now to FIGS. 1, 2 and 5, the primary coil assembly 24 is seen to comprise a laminated I-shaped core 36 molded within a bobbin 38. A primary terminal receptacle 40 is an integrally molded part of the bobbin 38 at one end thereof and includes a terminal seat portion 42. A second seat 44 extends from the bobbin 38 at its other end. Each seat 42,44 is adapted to mate with a first inner recess 46 and a second inner recess 48, respectively, formed on the core 20 as shown in FIG. 3.

For assembly purposes, to assure the coil assembly is oriented properly within the case, the seats 42,44 are laterally offset from one another as are the recesses 46,48. Thus, each functions as a piece orientation feature just as the key and keyway 52,54, respectively of the core and housing, as explained in detail below.

FIG. 3 shows a laminated C-shaped core 20 encased in a rubber modified polypropylene shell 50. The C-shaped laminated core is adapted to be received and slip fit inside the lower portion of the housing. The rubber modified polypropylene 50 such as sold by A Schulman, Inc. (USA) under the trademark Polytrope® (specification Nos. TPP 503, 504, 514, 517 and 524) and also sold by Advanced Elastomeric Systems (USA) under the trademark Santoprene® and Vistaflex® (TPR), specification Nos. 123-60 and 9203-54W900, respectively, is a preferred encasement material because it acts as a compliant, compressible, stress-relief layer between the metal C-core 20 and the housing 4. The surface chemistry of the encasement material must be non-bonding or non-reactive with the housing and potting material to allow for movement of the materials with respect to one another as well as provide relief from the effects of differing coefficients of expansion of the various materials. This non-bonding chemistry prevents cracking during thermal cycling or during extended time periods at elevated temperatures that ignition coil assemblies are commonly subject to.

A key 52 is positioned inside an inner portion of the housing 4 and a mateable keyway 54 is provided on the outside portion of the core and adapted to engage the key 52 of the housing 4.

Figure 6:
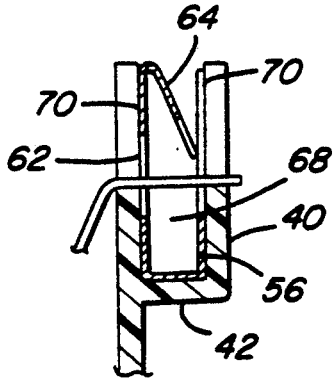
FIG. 6 is a sectioned side view taken along lines 6—6 of FIG. 5 and illustrating the insulation displacement terminal and a portion of the primary coil inserted within.

As shown in FIGS. 5 and 6, the primary bobbin 38 also has disposed above the primary terminal seat 42 a primary terminal receptacle 40 which is configured to receive a pair of insulation displacement terminals 56. A coil 58 is wound around the bobbin 38 with the terminating ends 60 of the coil 58 placed within the insulation displacement terminals 56 and confined within pairs of oppositely disposed, inverted V-shaped slots 62.

The terminating ends 60 of the primary coil 58 thus extend the length of the cavity within which the displacement terminal resides. The terminals 56 are U-shaped and include a spring biasing arm 64 which engages the leads 60. The terminals 56 are held in the cavity by burrs 66 on the sides of the terminals 56. Thus when the insulation displacement terminals 56 are positioned inside the primary terminal receptacle cavity 68, the terminal will be wedged in place against the sidewalls 68 of the cavity. Each insulation displacement terminal 56 includes inverted V-shaped slots 62 or coil receiving openings such that when the terminal is forced down into cavity 70 the primary coil terminating ends 60 will be engaged.

As shown in FIG. 6, the primary coil terminating ends 60 extend through both the primary terminal receptacle 40 and the insulation displacement terminals 56. As the coil receiving opening 62 is brought down upon the primary coil end portion 60, the insulation material deposited entirely along on the primary coil 58 is shaved off and direct electrical contact is made between the primary coil terminating ends 60 and the insulation displacement terminal 56.

The primary connector assembly 74 as shown in FIGS. 1 and 2 is made of an electrically insulating material. It has an electrode insulation segment 76 and a receptacle portion 78. Electrode insulation segment 76 is constructed to overlap a lip portion 80 of the housing 4 and extend down into the housing. Leg 18 is spaced from the receptacle portion 78 to provide a gap 82 slightly greater in width than the thickness of the housing such that the connector assembly will slip over the housing until the lip 80 engages the connector assembly at the bend 84. As earlier described the primary connector assembly 74 also includes a dove tail locking section 14 for use in affixing the primary connector assembly to the housing. Whereas the gap 82 retains the assembly 74 from outward separation from the housing, the locking section 14, specifically channel members 86 preclude relative lateral displacement.

Figure 7:
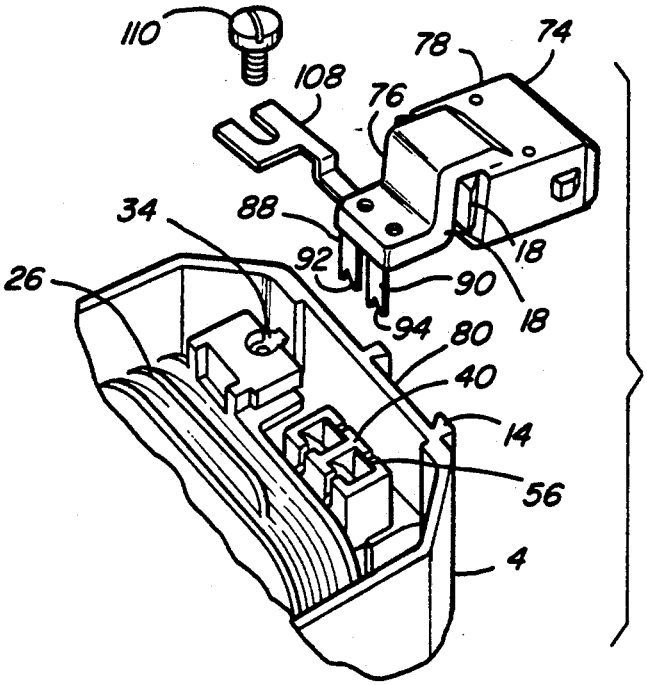
FIG. 7 is a perspective, exploded view of an alternative embodiment of the present invention showing a primary connector assembly and a bypass electrical connection utilized in a distributor-type ignition coil assembly.

As shown in FIG. 7, electrical leads 88 and 90 travel through the electrode insulation segment 76 and the receptacle portion 78. The electrical leads 88,90 have at their end portions, openings 92,94 which facilitate a direct electrical connection between the end portion of the electrical leads 88,90 and the primary coil 58.

As is conventional lead 88 receives ignition system control data from an onboard ignition control system and second primary connector assembly electrical lead 90 receives 12 volt input from the vehicle battery system.

To assemble the coil assembly 2, the primary coil assembly 24 is inserted within secondary coil assembly 26. Separately the core 20 is inserted within housing 4. Then the combined coil assembly 24,26 is placed within the cavity 22 of core 20 such that primary terminal seats 42 and extension seat 44 of the primary bobbin 38 rest within recesses 46 and 48, respectively of C-shaped core 20. The secondary coil assembly 26 and the primary coil assembly 24 are thus supported within the inner open cavity 22 of the C-shaped laminated core 20.

Towers 96 are then threaded into secondary terminals 34. A molding resin 98 is subsequently introduced into the inner portion of the housing after all components have been assembled and the molding resin covers and electrically insulates the entire ignition coil assembly.

Figure 8:
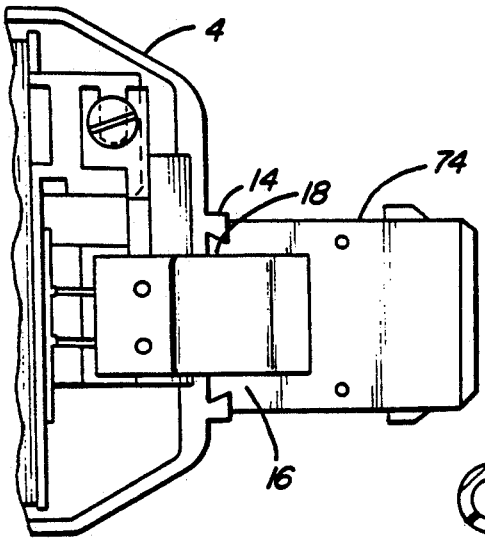
FIG. 8 is a segmented top view of an alternative embodiment of the primary connector assembly illustrating a bypass electrical connection and the dovetail locking and receiving sections.

FIGS. 7 and 8 show an alternative embodiment of the present invention adapting an ignition coil assembly suitable for use with a distributorless ignition system to an ignition coil assembly suitable for use with a distributor-based ignition system. Removal of one high voltage tower 96 and the addition of a slightly modified primary connector assembly effectively transforms the ignition coil assembly to a distributor type coil for use in a conventional internal combustion engine. Specifically, the modified primary connector assembly of this embodiment utilizes a bypass member 108 which connects the secondary terminal 34 to the second electrical lead 88 which is the positive terminal of the primary coil. Electrical lead 88 is at low voltage, i.e. 12 volts for the conventional 12 volt system and thus provides a virtual ground. Fastening screw 110 secures bypass electrical connection 108 to terminal 34.

Figure 9:
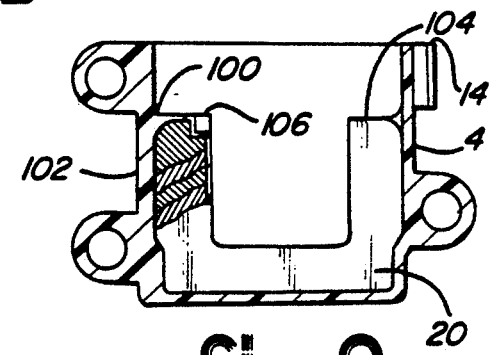
FIG. 9 shows an alternative embodiment of the present invention in partial cross-section wherein the core is molded within the coil assembly housing.

FIG. 9 shows a further embodiment of the present invention wherein the core 20 is molded entirely within the inner and outer walls 100,102 of the housing. The core 20 entirely encased within the housing is provided with a first inner recess 104 and a second inner recess 106 adapted to mate with the terminal seat portion 42 and the second seat 44 of the bobbin 38. The corresponding position of the inner recesses is identical to that shown in FIG. 3. Alternatively, a rubber coated core, not shown, may be insert molded between the inner and outer walls of the assembly housing 2.

While the best mode for carrying out the invention has been described in detail, those familiar with the art to which this invention relates will recognize various alternative designs and embodiments for practicing the invention as defined by the following claims.

We claim:

1. An ignition coil assembly for an ignition system suitable for use in an internal combustion engine comprising:

a housing made of an electrical insulating material and provided with at least one mounting member integrally formed with said housing;

an electro-magnetic core assembly located within said housing and comprising at least a primary core member, a primary coil, and a secondary coil;

one of said housing and said primary core member being provided with an elongate keyway and the other of said housing and said primary core member being provided with an elongate key mateable to said elongate keyway for positioning said primary core member within said housing;

said one mounting member having a through-bore adapted to receive a fastener for securing said housing to a support, and said one mounting member being located outside the boundaries of said coil assembly whereby the housing provides means for insulating the coil assembly.

2. An ignition coil assembly for an ignition system using a distributor suitable for use in a internal combustion engine comprising;

a housing made of an electrically insulating material;

a C-shaped first core having an inner open cavity;

a secondary bobbin located within said inner open cavity of said first core and having a pair of secondary terminals;

a secondary coil wound on said secondary bobbin and connected to said secondary terminals;

a second core;

a primary bobbin encasing said second core, said primary bobbin being located within said secondary bobbin and having a pair of primary terminals;

said secondary coil being slip-fitted within said primary bobbin;

a primary coil wound on said primary bobbin and connected to said primary terminals; and a primary connector assembly having a pair of electrical leads engaging said primary terminals and providing a virtual ground for one of said secondary terminals by electrically coupling it to one of said electrical leads within said connector assembly.

3. An ignition coil assembly according to claim 2 wherein said primary connector assembly includes a bypass member extending from one said lead to a secondary terminal and a fastening means for securing said member to cooperate with said one high voltage terminal.

4. An ignition coil assembly according to claim 2 wherein said housing is provided with a lip portion and said primary connector assembly is made of an electrical insulating material having a receptacle member and an electrode insulation segment; said electrode insulation segment traversing said lip portion of said housing and extending down into said housing.

5. An ignition coil assembly for an internal combustion engine ignition system using a distributor for time distribution of the coil voltage output to a particular combustion cylinder and for an ignition system distributing ignition coil output directly to a designated combustion cylinder comprising:

a housing made of an electrically insulating material;

a first core within said housing;

a first bobbin having two secondary terminals;

a coil wound on said first bobbin and connected to said two secondary terminals;

a second core;

a second bobbin encasing said second core and having a pair of primary terminals;

a coil wound on said second bobbin and connected to said primary terminals;

a first primary connector having a pair of electrical leads adapted to engage said primary terminals and means for providing a virtual ground for the secondary coil by connecting it to one of said electrical leads;

a second primary connector having a pair of electrical leads adapted to engage said primary terminals only;

said pair of primary terminals and said secondary terminal receiving said first primary connector when said ignition coil assembly is used for a distributor-based ignition system; and said pair of primary terminals and said high voltage terminal receiving said second primary connector when said ignition coil assembly is used in an ignition system distributing ignition coil output directly to a designated combustion cylinder.

6. A method of manufacturing and assembling from a single production line an ignition coil assembly for internal combustion engine system which can alternatively be used in a system requiring (i) a distributor for time distribution of the coil voltage output to a particular combustion cylinder and (ii) distributing ignition coil output directly to a designated combustion cylinder ignition device, said coil assembly having a housing made of an electrically insulating material, a first core, a first bobbin having two secondary tower terminals, a coil wound on said first bobbin and connected to said two secondary terminals, a second core, a second bobbin encasing said second core and having a pair of primary terminals, a coil wound on said second bobbin and connected to said primary terminals, a first primary connector having a pair of electrical leads adapted to engage said primary terminals and means for providing a virtual ground for the secondary coil by connecting it to one of said electrical leads, a second primary connector having a pair of electrical leads adapted to engage said primary terminals, said method comprising:

connecting said first primary connector to said primary terminals and to one of said secondary terminals when said ignition coil assembly is used as a distributor-based ignition system, connecting said second primary connector to said primary terminals when said ignition coil assembly is used for an internal combustion engine using an ignition system distributing ignition coil output directly to a designated combustion cylinder.

7. An ignition coil assembly for an ignition system suitable for use in a multicylinder vehicular internal combustion engine comprising:

a housing made of an electrical insulating material and provided with at least one mounting member integrally formed with said housing;

an electro-magnetic core assembly located within said housing and comprising:

(a) a laminated first core within said housing which is generally C-shaped and thereby providing an inner open cavity with the confines of said C-shaped first core, (b) a generally cylindrical and hollow first bobbin having two secondary terminals, (c) a secondary coil wound on said first bobbin and connected to said two secondary terminals, (d) a laminated second core which is generally I-shaped, (e) a second bobbin encasing said second core and having a pair of primary terminals, and (f) a primary coil wound on said second bobbin and connected to said primary terminals;

said second core and second bobbin providing a primary coil subassembly and being received within the hollow of said first bobbin;

said first bobbin and said primary coil subassembly residing within the open cavity of said first core with said I-shaped second core extending transversely between the ends of said C-shaped core member;

said first core being completely encased within a rubber-modified polypropylene shell non-bonding and non-reactive with said housing whereby each may move relative to the other during any thermal cycling of the ignition coil assembly during use;

said one mounting member having a through-bore adapted to receive a fastener for securing said housing to a support, and said one mounting member being located outside the boundaries of said coil assembly whereby the housing provides means for insulating the coil assembly.

* * * * *